US006290540B1

(12) United States Patent
Nishio et al.

(10) Patent No.: US 6,290,540 B1
(45) Date of Patent: Sep. 18, 2001

(54) ELECTRICAL CONNECTOR

(75) Inventors: Atsushi Nishio, Ibaraki; Katsuhiro Hori, Mito, both of (JP)

(73) Assignee: Mitsumi Newtech Co., Ltd. (JP)

( * ) Notice: Subject to any disclaimer, the term of this patent is extended or adjusted under 35 U.S.C. 154(b) by 0 days.

(21) Appl. No.: 09/491,835

(22) Filed: Jan. 26, 2000

(30) Foreign Application Priority Data

Jan. 27, 1999 (JP) ..... 11-018584

(51) Int. Cl.[7] ..... H01R 13/648
(52) U.S. Cl. ..... 439/607
(58) Field of Search ..... 439/61, 73, 75, 439/76.1, 141, 604, 607, 608, 609, 610, 624, 708, 710, 865, 901

(56) References Cited

U.S. PATENT DOCUMENTS

D. 408,788 * 4/1999 Homma ..... D13/147
D. 409,570 * 5/1999 Wu ..... D13/147
D. 431,530 * 10/2000 Nishio et al. ..... D13/147
4,875,863 * 10/1989 Reed ..... 439/79
5,254,010 * 10/1993 Davis ..... 439/108
5,928,035 * 7/1999 Jankowsky et al. ..... 439/607
5,947,754 * 9/1999 Lin ..... 439/79
6,095,837 * 8/2000 David et al. ..... 439/188
6,109,967 * 8/2000 Chiou ..... 439/607
6,120,323 * 9/2000 Zhung et al. ..... 439/567

* cited by examiner

*Primary Examiner*—Tulsidas Patel
(74) *Attorney, Agent, or Firm*—Morrison Law Firm

(57) ABSTRACT

An insulative housing has grooves disposed on an upper surface. The lower surface is closed to protect the electrical connectors from solder flux when soldering the housing to a printed circuit substrate. The enclosed electrical connectors make electrical contact with the corresponding connectors in an insertable plug. The grooves are open along a top surface and allow the enclosed electrical connectors to connect with the corresponding connectors disposed on a bottom surface of the insertable plug. The insulative housing is disposed within a socket that is soldered to a printed circuit substrate. The insertable plug, insulative housing and socket together comprise a miniature connector.

3 Claims, 4 Drawing Sheets

ELECTRICAL CONNECTOR

BACKGROUND OF THE INVENTION

The present invention relates to an electrical connector. More specifically, the present invention relates to a miniature electrical connector used for connecting electronic devices such as personal computers.

Recently, personal computers have begun to use miniature electrical connectors referred to as USB (Universal Serial Bus) connectors.

Referring to FIG. 5, a miniature electrical connector, typically includes: a connector socket 2A mounted on a printed circuit substrate 1A. A connector plug 3A, is insertable within connector socket 2A. Connector socket 2A includes a shield case 4A, which is formed by bending a metal sheet in the shape of a rectangular column.

Within shield case 4A, an insulative housing 6A supports four contact pins 5A. Contact pins 5A are laterally arranged side-by-side. An intermediate section of contact pins 5A is fixed to an insulative housing base 6*a*. This arrangement connects external connecting ends 5*a* to contact pins 5A. An end support 6B is integrally molded with the upper half of insulative housing base 6*a*. End support 6B is formed so that its vertical thickness is roughly half that of shield case 4A. A bottom surface of end support 6B supports a contact end 5*b* of contact pins 5A.

End support 6B has downwardly opening grooves disposed on a bottom surface and arranged along an axis perpendicular to the plane of the page. Contact ends 5*b* of the contact pins 5A are fitted into the grooves.

Connector plug 3A couples with connector socket 2A. Connector plug 3A includes a shield case 7A formed as a rectangular column that fits within shield case 4A. A space 8A is disposed inside a plug shield 7*a* of shield case 7A. Space 8A receives end support 6B. A contactor 10A has a contact end 10*a* positioned directly below space 8A. Contact end 10*a* is supported by an end support 9*a*. End support 9*a* is part of an insulative housing 9A.

The conventional connector socket 2A is fixed on a printed circuit substrate 1A via soldering to a conductor layer (not shown in the figure) of printed circuit substrate 1A. A contact piece 11A is cut out from a bottom surface 4*a* of shield case 4A and leaves a slot 12*c* in bottom surface 4*a*.

Unfortunately, solder flux can enter connector socket 2A through slot 12*c* when connector socket 2A is soldered to printed circuit substrate 1A. The flux can adhere to contact end 5*b* adversely affecting the electrical connection between contact end 10*a* and contact end 5*b*.

The above, and other objects, features and advantages of the present invention will become apparent from the following description read in conjunction with the accompanying drawings, in which like reference numerals designate the same elements.

OBJECTS AND SUMMARY OF THE INVENTION

It is an object of the present invention to is to overcome the problems of the conventional connector described above.

It is another object of the present invention to provide a reliable miniature connector that makes good electrical connections by preventing solder flux from adhering to contact ends.

Briefly stated, the present invention provides an insulative housing with grooves disposed on an upper surface. The lower surface is closed to protect the electrical connectors from solder flux when soldering the housing to a printed circuit substrate. The enclosed electrical connectors make electrical contact with the corresponding connectors in an insertable plug. The grooves are open along a top surface and allow the enclosed electrical connectors to connect with the corresponding connectors disposed on a bottom surface of the insertable plug. The insulative housing is disposed within a socket that is soldered to a printed circuit substrate. The insertable plug, insulative housing and socket together comprise a miniature connector.

According to an embodiment of the invention, there is provided An electrical connector comprising: an insulative housing; the insulative housing having an end support; the end support having at least one groove disposed along a top surface; the at least one groove opening upward; and at least one electrical connector disposed within the at least one groove whereby the at least one electrical connector is protected from solder flux when the insulative housing is soldered to a printed circuit substrate.

According to another embodiment of the invention, there is provided An electrical connector comprising: a socket; means for fixing the socket to a substrate; an insulative housing within the socket; the insulative housing having an end support; the end support having at least one groove disposed along a top surface; the at least one groove opening upward; and at least one electrical connector disposed within the at least one groove whereby the at least one electrical connector is protected from solder flux when the insulative housing is soldered to a printed circuit substrate.

According to yet another embodiment of the invention, there is provided An electrical connector comprising: a socket; means for fixing the socket to a substrate; an insulative housing; the insulative housing disposed within the socket; the insulative housing having an end support; the end support having at least a first groove disposed along a top surface; the at least first groove opening upward; at least a first electrical connector disposed within the at least first groove whereby the at least first electrical connector is protected from solder flux when the insulative housing is soldered to a printed circuit substrate; a plug; the plug having at least a second electrical connector disposed within the plug; and the at least second electrical connector being downwardly open wherein the at least first electrical connector makes contact with the at least second electrical connector when the plug is inserted in the insulative housing.

In order to achieve the objects described above, the present invention proposes an electrical connector including: a connector socket having a shield case, which is formed by bending a metal sheet in the shape of a rectangular cylinder, and an insulative housing, which is installed inside the shield case while supporting a plurality of contact pins; and a connector plug having a plug inserted inside an insertion opening of the connector socket. A plurality of upwardly opened attachment grooves is formed on the upper surface of an end support formed integrally with the insulative housing. The contact ends of the contact pins are positioned in the attachment grooves.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
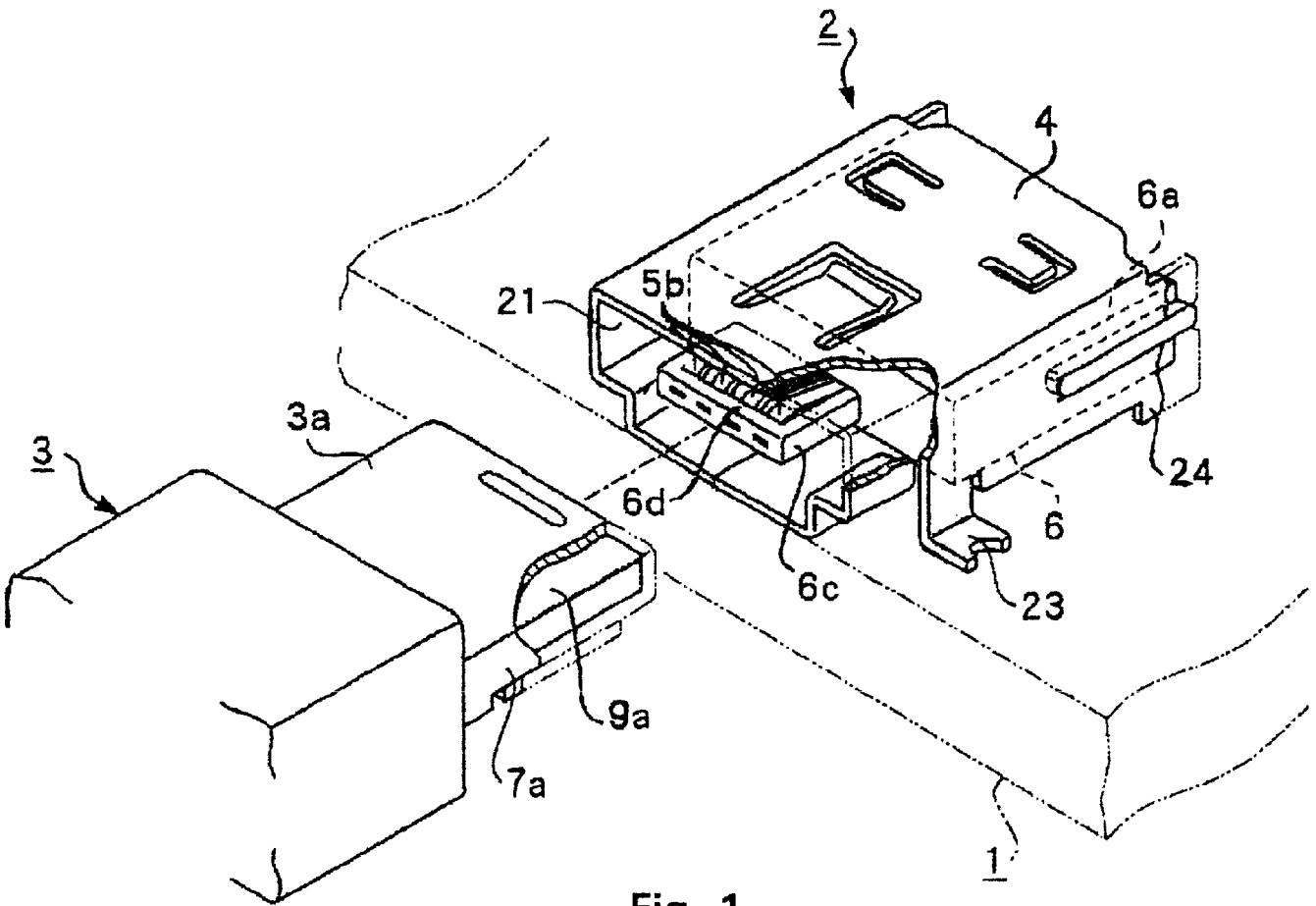
FIG. 1 is an exploded perspective drawing, with one portion cut away, of an electrical connector according to the present invention.
Figure 2:
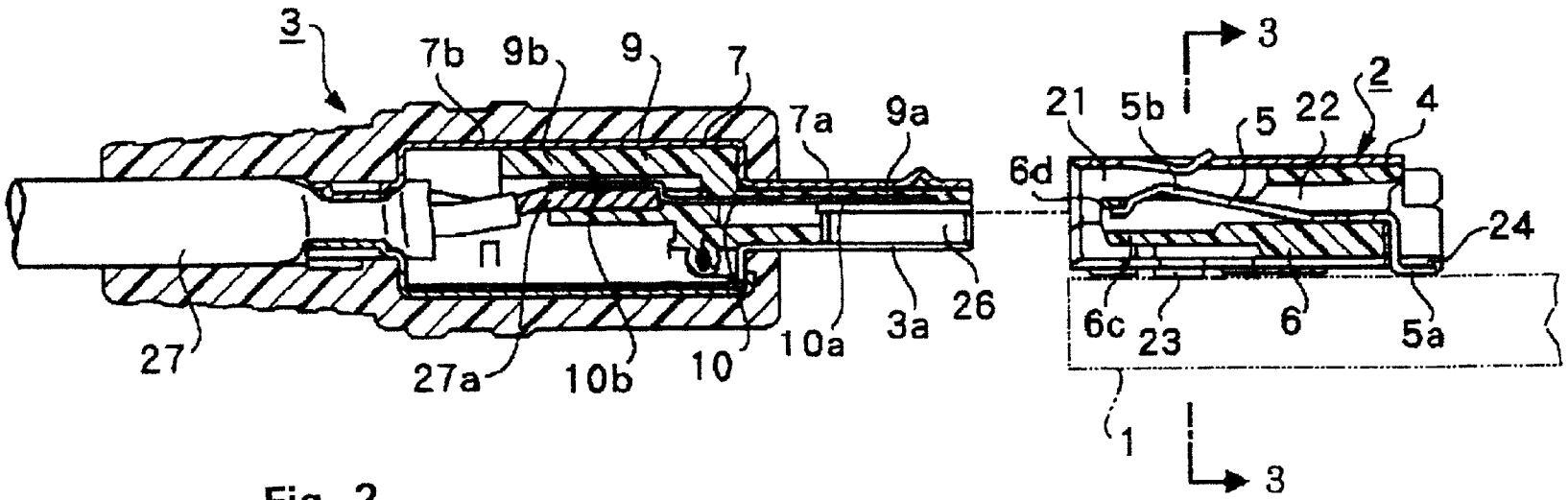
FIG. 2 is a longitudinal cross-section drawing of the miniature connector.

Referring to FIGS. 1 and 2, an electrical connector includes a connector socket 2 mounted on the surface of a printed circuit substrate 1. A connector plug 3 has a plug 3*a* that fits into an insertion opening 21 disposed in connector socket 2. Connector socket 2 includes a shield case 4 formed by bending a sheet of metal into a rectangular column which defines insertion opening 21.

An insulative housing 6, molded from resin, is positioned inside shield case 4. Insulative housing 6 supports four contact pins 5. Contact pins 5 are arranged in a row along the lateral axis of shield case 4.

Insulative housing 6 is inserted into shield case 4 from the rear. Insulative housing 6 includes a base 6*a*. Base 6*a* has a cross-sectional dimension that is roughly the same as the cross-sectional dimension of the inside of shield case 4.

An end support 6*c* is formed integrally with base 6*a* as a cantilevered projection within shield case 4. Four parallel attachment grooves 22 are formed along the length of end support 6*c* and base 6*a*. Attachment grooves 22 are arranged parallel to each other along the lateral axis of shield case 4. Elastic metal contact pins 5 are positioned in each attachment groove 22. An intermediate section of contact pins 5 is fixed within corresponding attachment grooves 22. External connection ends 5*a*, formed as L-shaped bends in contact pins 5, extend out from the rear of shield case 4. External connection ends 5*a* are soldered to the conductor layer of printed circuit substrate 1.

Contact ends 5*b* are formed as arcuate bends in contact pins 5. Contact ends 5*b* are exposed upwardly from within attachment grooves 22 on an upper surface of end support 6*c*. Contact ends 5*b* are held by engagement pieces 6*d*. Engagement pieces 6*d* are formed integrally with an end of end support 6*c*. Engagement pieces 6*d* prevent external connection ends 5*a* from freely projecting outside corresponding attachment grooves 22.

Figure 3:
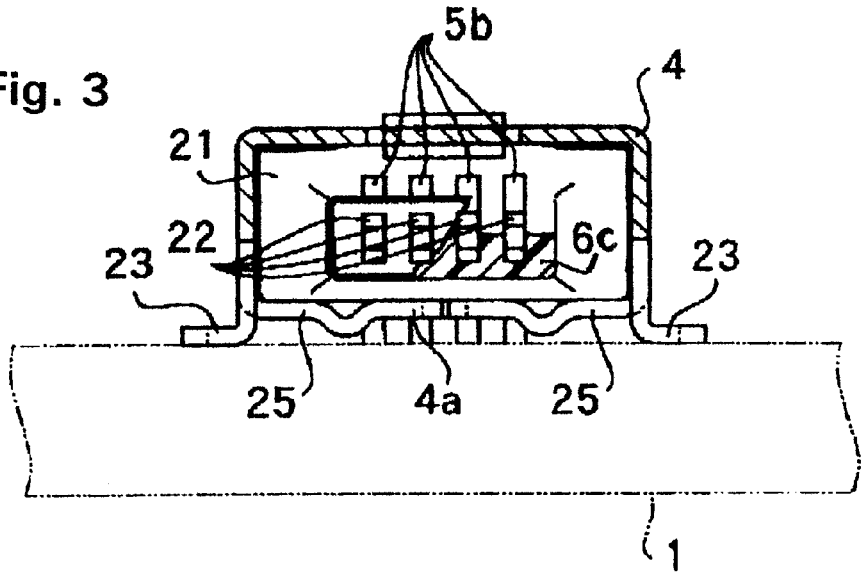
FIG. 3 is a detail cross-section drawing along the 33 line from FIG. 2 of the miniature connector.

Referring to FIGS. 2 and 3, connector plug 3 is covered with an outer insulative resin covering. Plug 3*a* includes a plug shield 7*a* Plug shield 7*a* has an outer dimension that corresponds to the inner dimension of shield case 4. Plug 3*a* fits within insertion opening 21. An end support 9*a* of an insulative housing 9 is positioned inside plug shield 7*a*. End support 9*a* supports four contactors 10. Contactors 10 and contact pins 5 are aligned with each other.

Figure 4:
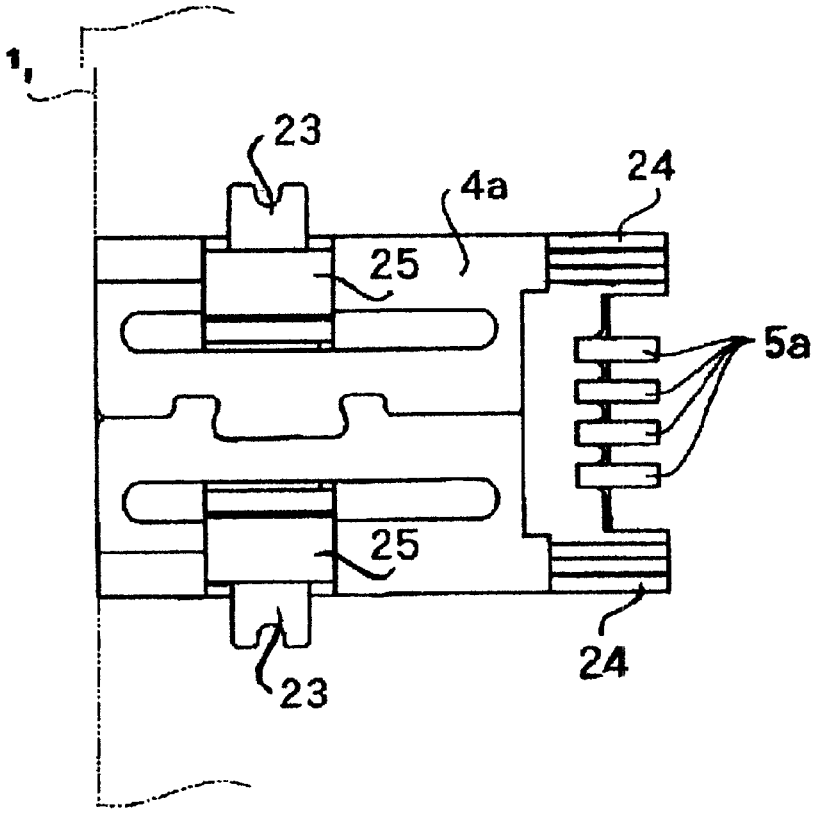
FIG. 4 is a detail bottom-view drawing of a connector socket of the miniature connector.
Figure 5:
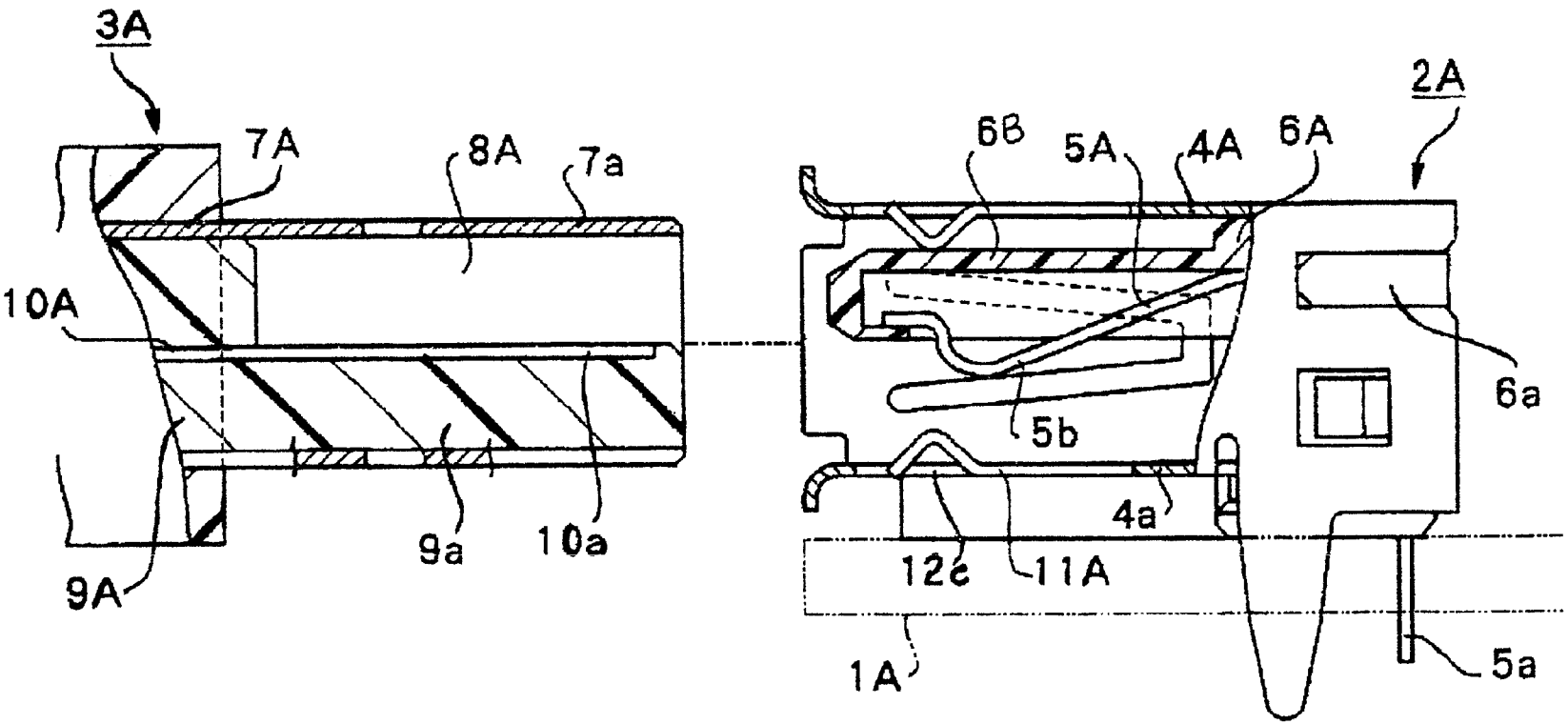
Fig. 5 PRIOR ART
FIG. 5 is an enlarged side-view drawing of a conventional USB connector showing one portion cut away.

Referring now to FIGS. 1 and 4, a pair of affixing wings 23 are formed at the bottom edges of a bottom surface 4*a* of shield case 4. Each affixing wing 23 is bent to form an L-shaped structure with the foot of the L-shaped affixing wing 23 facing printed circuit substrate 1. A pair of affixing legs 24 are formed by cutting rear sections of shield case 4 so that a left and right leg section projects downward towards printed circuit substrate 1. Openings are produced in shield case 4 when the outlines of affixing wings 23 and affixing legs 24 are cut into shield case 4. A slot 25 is produced when affixing wing 23 is cut and bent into shape.

Referring to FIG. 2, contact ends 10*a* of contactors 10 are exposed at a bottom surface of end support 9*a*. Contact ends 10*a* extend along an upper wall of plug shield 7*a*. A space 26 is bounded by end support 9*a* and plug shield 7*a*. Space 26 receives end support 6*c* of insulative housing 6 described above. Thus, when plug 3*a* of connector plug 3 is fitted into insertion opening 21, end support 6*c* and end support 9*a* are brought close to each other. End support 6*c* is positioned just below end support 9*a* so that they face each other. As a result, contact ends 10*a* of contactors 10 come into contact with corresponding contact ends 5*b* of contact pins 5.

Shield case 7, described above, includes a cord shield 7*b*. Cord shield 7*b* is formed integrally with plug shield 7*a*. Cord shield 7*b* is formed to enclose a comparatively large volume. A cord connector 9*b*, which is connected to end support 9*a*, is positioned inside cord shield 7*b*. Cord connection ends 10*b* of contactors 10 are positioned within cord connector 9*b*. Cord connection ends 10*b* are fixed via solder to wires 27*a* in a connection cord 27. Connection cord 27 feeds in from an end of cord shield 7*b*.

Contact ends 5*b* disposed within grooves 22 are protected from below by end support 6*c* of insulative housing 6. Any solder flux entering shield case 4 through slots 25 during the soldering process, is blocked from adhering to contact ends 5*b* by end support 6*c*. As a result, a reliable electrical connection between contact ends 5*b* and contact ends 10*a* is achieved.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrical connector comprising:

insulative housing;

said insulative housing having an end support;

said end support includes at least one engagement piece disposed on an end surface;

said end support having at least one groove disposed along a top surface;

said top surface opposite a bottom surface of said end support;

said at least one groove opening upward in said top surface;

at least one electrical connector disposed within said at least one groove;

said electrical connector resiliently retained by said engagement piece at an end portion of said electrical connector;

said electrical connector having a middle portion resiliently extending above said at least one groove;

said electrical connector being supported and protected by said end support and retained and protected by said engagement piece and said at least one groove, whereby said at least one electrical connector is protected from solder flux during soldering;

a shield case;

said shield case being effective to operably support said insulative housing and shield said housing from solder flux;

said end support having a cantilevered projection disposed within said shield case;

said shield case having at least first and second slots opposite said bottom surface of said end support;

said at least first and second slots opposite first and second fixing wings; and said cantilevered projection, said at least one groove, and said at least one engagement piece being effective to protect said at least one electrical connector from solder flux entering said shield case through said first and second slots during soldering.

2. An electrical connector comprising:

a socket;

means for fixing said socket to a substrate;

an insulative housing;

said insulative housing disposed within said socket;

said insulative housing having an end support;

said end support having at least one engagement piece disposed on an end surface;

said end support having at least a first groove disposed along a top surface;

said top surface opposite a bottom surface of said end support;

said at least first groove opening upward in said top surface;

at least a first electrical connector disposed within said at least first groove;

said first electrical connector resiliently retained by said engagement piece at an end portion;

said first electrical connector having a middle portion resiliently extending beyond said at least one groove;

said first electrical connector being supported and protected by said end support, retained and protected by said engagement piece, and within said groove, whereby said at least first electrical connector is protected from solder flux during soldering;

a plug;

said plug having at least a second electrical connector disposed within said plug;

said at least second electrical connector having a female mating shape and being opposite said top surface; and said at least first electrical connector makes elastic and male electrical contact with said at least second electrical connector when said plug is inserted in said socket, thereby enabling electrical connection between said plug and said first electrical connector on said insulated housing.

3. An electrical connector comprising:

a shield case having at least a bottom side and an opposite side;

said shield case having at least first and second slots proximate integral support legs on said bottom side adjacent an external substrate;

an insulating housing within said shield case between said bottom and said opposite sides;

said insulative housing having an end support above said bottom side;

said end support having a cantilevered projection opposite said first and second slots;

said end support having at least one groove and at least one engagement piece;

said at least one groove opening away from said first and second slots;

said at least one engagement piece opposite said first and second slots;

at least one electrical connector disposed within said at least one groove;

said at least one groove substantially surrounding said at least one electrical connector;

said engagement piece resiliently retaining said electrical connector within said at least one groove on a top side;

said electrical connector having a middle portion resiliently extending beyond said groove; and said end support, said groove, and said engagement piece between said electrically connector and said first and second slots whereby said electrical connector is protected from solder flux entering said at least first and second slots during soldering.

* * * * *